US011358070B2

(12) United States Patent
Åberg

(10) Patent No.: US 11,358,070 B2
(45) Date of Patent: Jun. 14, 2022

(54) BUILDING SYSTEM FOR CREATING THREE-DIMENSIONAL STRUCTURES

(71) Applicant: Erik Åberg, Stockholm (SE)

(72) Inventor: Erik Åberg, Stockholm (SE)

( * ) Notice: Subject to any disclaimer, the term of this patent is extended or adjusted under 35 U.S.C. 154(b) by 0 days.

(21) Appl. No.: 17/287,930

(22) PCT Filed: Oct. 14, 2019

(86) PCT No.: PCT/SE2019/051008

§ 371 (c)(1),
(2) Date: Apr. 22, 2021

(87) PCT Pub. No.: WO2020/085974

PCT Pub. Date: Apr. 30, 2020

(65) Prior Publication Data

US 2021/0308596 A1 Oct. 7, 2021

(30) Foreign Application Priority Data

Oct. 23, 2018 (SE) ..... 1851306-9

(51) Int. Cl.
*A63H 33/06* (2006.01)
*A63H 33/08* (2006.01)

(52) U.S. Cl.
CPC ..... *A63H 33/062* (2013.01); *A63H 33/086* (2013.01)

(58) Field of Classification Search
CPC .... A63H 33/044; A63H 33/06; A63H 33/062; A63H 33/086; A63H 33/088
(Continued)

(56) References Cited

U.S. PATENT DOCUMENTS 2,057,942 A * 10/1936 Aurele ..... A63H 33/108 446/112
3,940,142 A * 2/1976 Hinz ..... A63F 9/0413 273/146

(Continued)

FOREIGN PATENT DOCUMENTS

| | | |
|---|---|---|
| CN | 204910786 U | 12/2015 |
| GB | 2429934 A | 3/2007 |
| WO | 2008152164 A1 | 12/2008 |

OTHER PUBLICATIONS

International Search Report and Written Opinion dated Jan. 23, 2020, issued in corresponding International Application No. PCT/SE2019/051008, filed on Oct. 14, 2019, 8 pages.

(Continued)

*Primary Examiner* — Joseph B Baldori
(74) *Attorney, Agent, or Firm* — Christensen O'Connor Johnson Kindness PLLC

(57) ABSTRACT

Building systems for creating three-dimensional structures include a plurality of polyhedral units, each unit being hingedly coupled to at least one adjacent unit, wherein the plurality of polyhedral units is arranged to be interchangeably manipulated between various forms of three-dimensional structures. The building system includes at least two types of plate-like building elements, including a single-piece element and a double-piece element that is formed of two single-piece elements arranged adjacent each other and being hingedly attached to each other at one of the edges of each of the two adjacently arranged single-piece elements.

20 Claims, 6 Drawing Sheets

(58) Field of Classification Search
USPC ..... 446/102, 104, 108, 109, 111, 112, 113, 446/114, 115, 116, 120
See application file for complete search history.

(56) References Cited

U.S. PATENT DOCUMENTS 4,055,019 A * 10/1977 Harvey ..... A63F 9/12 446/115
4,253,268 A 3/1981 Mayr
4,685,892 A * 8/1987 Gould ..... A63H 33/062 446/109
4,731,041 A * 3/1988 Ziegler ..... A63H 33/065 446/115
5,538,452 A 7/1996 Kurani
5,664,387 A * 9/1997 Bhatti ..... A63H 33/088 446/102
5,746,038 A * 5/1998 Houk ..... E04B 1/02 446/116
6,142,848 A * 11/2000 Madner ..... A63H 33/04 446/107
6,186,855 B1 2/2001 Bauer et al.
6,565,406 B2 * 5/2003 Huang ..... A63H 33/042 446/104
7,192,329 B2 * 3/2007 Lee ..... A63H 33/04 428/34.1
7,438,623 B2 * 10/2008 Lin ..... A63H 33/086 446/104
7,749,042 B2 * 7/2010 Fulgenzi ..... A63H 33/062 446/108
8,109,803 B2 * 2/2012 Kichijo ..... A63H 33/108 446/109
9,266,030 B2 * 2/2016 Graube ..... A63H 33/062
9,522,342 B2 * 12/2016 Jazouli ..... A63H 33/086
2002/0098774 A1 * 7/2002 Huang ..... G09B 19/02 446/487

OTHER PUBLICATIONS

Japanese Notice of Reasons for Rejection issued in corresponding Japanese Patent Application No. 2021-536732, filed on Oct. 14, 2019, and its English translation thereof, 10 pages.

* cited by examiner

BUILDING SYSTEM FOR CREATING THREE-DIMENSIONAL STRUCTURES

CROSS-REFERENCES TO RELATED APPLICATIONS

This application is a National Stage of International Application No. PCT/SE2019/051008 filed Oct. 14, 2019, which claims priority to Swedish Patent Application No. 1851306-9 filed on Oct. 23, 2018, the disclosures of which are hereby incorporated by reference in entirety for all purposes.

TECHNICAL FIELD

The present invention relates to a building system for creating modifiable three-dimensional structures, and such a three-dimensional structure, according to the appended claims.

BACKGROUND ART

Three-dimensional structures such as kinetic sculptures, visual art, performance items, toys and similar are used for a wide range of varying applications. Such structures when provided with the possibility to modify their shape and form may be visually interesting and pleasing to watch, whereas they may be used for illusions, performance art or as relaxing toys etc. Such structures may also serve practical usages as they may be modified in shape between a useful shape such as a piece of furniture and a more compact shape that is easier to store in small spaces, or take up less space during transportation, as an example.

When creating and assembling such three-dimensional structures a lot of work is often needed, especially for more complex and/or larger structures. Many such structures are often comprised of a plurality of smaller units, which are connected to each other in an intricate manner. To provide movability and various types of functions and options with regards to the completed structure, a large plurality of pieces may have to be made, and also assembled together in a time consuming and difficult process. Often such complex structures may also only have a single or a few possible variations thereof to present, wherein a new but similar structure may need to be created from scratch. To create a large plurality of various such structures may thus be very demanding and time consuming.

SUMMARY OF THE INVENTION

Despite prior art there is a need to develop an improved building system, which is easy and intuitive to use. There is also a need to develop such a system, which may be assembled and re-assembled in different three-dimensional structures. There is even further a need to develop such a three-dimensional structure, which is comprised of building elements of the building system.

According to a first aspect, a building system for creating three-dimensional structures is provided. The structures may be comprised of a plurality of polyhedral units, each unit may be hingedly coupled to at least one adjacent unit, wherein the plurality of hinged units are arranged to be interchangeably manipulated between various forms of said three-dimensional structures. The system may further comprise at least two types of plate-like building elements, a single-piece element having at least three edges, which constitute a circumference of said single piece element, and a double-piece element that is comprised of two single-piece elements arranged adjacent each other. The two single-piece elements creating a double-piece element may be hingedly attached to each other at one of the edges of each of the two adjacently arranged single-piece elements. Furthermore, an inner portion of each edge of each element may be provided with coupling means arranged for coupling elements together along their edges so as to create polyhedral units, and wherein each polyhedral unit of a completed three-dimensional structure is comprised of at least one single-piece element and at least one double-piece element.

This has the advantage that a very versatile building system is provided. The system may easily and fast be assembled and re-assembled into endless variations of three-dimensional structures that are hinged together so as to be able to be manipulated into various shapes and designs. The system is easy to understand and to use, which is accentuated by the use of a low amount of different types of building elements, and wherein the double-piece element basically is comprised of two single-piece elements, hinged together side by side. This makes coupling possibilities intuitive and easy to perform. Furthermore, as the double-piece element is designed in such a manner, a single-piece element of a specific polyhedral unit may readily be replaced by half of a double-piece element, wherein said half of the double-piece element may take the place of the single-piece so as to acquire the original shape of said polyhedral unit. The other half of the double-piece element may then simply be bent away from the polyhedral unit the double-piece element is a part of, wherein the bent away other half of said element may be coupled to more pieces, either single-pieces or double-pieces, so as to create more and more complex and interesting structures in a very easy manner.

According to an aspect, the building elements may be made of a uniform material, and the hinged attachment of two single-piece elements forming a double-piece element may be comprised of at least one bridging strip of said uniform material.

This has the advantage that the building elements may be manufactured in a fast and cost effective way. Both the single-piece elements and the double-piece elements may thus be made without complex assembly processes, as they may be manufactured in single pieces of material without the need for fasteners or similar. The hinged portion in the form of the at least one bridging strip of the two single-piece elements constituting a double-piece element may thus also be made as a common part shared between the two halves of a double-piece element, wherein the double-piece elements may be manufactured without the need for additional process steps compared to the single-piece elements. This provides for an efficient manufacturing process in which a fast production may be achieved at low costs.

According to an aspect, each single-piece element may comprise a through-hole at a centre of each said element.

This provides an interesting and visually pleasing design when the building elements are arranged in various three-dimensional structures. The through-holes may also aid in visibility of more polyhedral units, which makes the structures easier to manage and visually more interesting to view for a spectator. Furthermore, the through-holes may also provide the additional benefit of making the polyhedral units easier to de-assemble, as the through-holes may be used to insert fingers and/or auxiliary elongated rod-like tools or similar therein, which may aid in providing more force to a building element of a polyhedral unit when it is to be removed from said unit. The through-holes furthermore provide an easier handling of three-dimensional structures assembled using such building elements, as there are more and easier grips to utilize for a user of such a structure.

According to an aspect, each building element may comprise an outer surface and an inner surface, wherein the coupling means of each edge of each building element are arranged at the inner surfaces of the building elements.

This has the advantage that the coupling means are more protected from external interactions when the building elements are arranged into polyhedral units. The coupling means are also not visible at all when polyhedral units are assembled, as they all are situated at what becomes an inner volume of such a unit, defined by an outer casing of building elements. This provides a more visually pleasing appearance, with lesser details in view for a spectator.

According to an aspect, the coupling means of each edge of each building element may be arranged at the inner surfaces by means of intermediate flanges, which flanges protrude perpendicular to the inner surface and extend parallel to each edge, at a distance from said each edge, which distance is equal to a protruding length of the flanges.

This has the advantage that the coupling means will be situated in an even more protected and non-visible position when polyhedral units are assembled. The coupling means will thus be positioned in pockets of sorts, defined by the inner surface of the building elements and the flanges thereof, wherein they will be protected from harm from a plurality of directions.

According to an aspect, the coupling means of each edge of each building element may be comprised of at least one claw and at least one pin, wherein coupling of two building elements may be achieved by means of at least one pin of one element being fitted into at least one claw of an adjacent element.

This has the advantage that an easy to handle coupling is provided, which coupling may be performed without the need for any tools or similar. The claw and pin may thus function as form-fitting coupling means, wherein the two parts thereof may simply be snapped together and/or fitted in a gliding manner.

According to an aspect, each edge of each building element may comprise at least one claw and at least one pin, wherein for each edge, the at least one claw and the at least one pin are positioned at opposite sides of a centre of said edge, at an equal distance from said centre.

This has the advantage that two building element being arranged edge to edge adjacent each other always will line up with a claw of one element towards a pin of the other element, and vice versa. This will be the case for each edge of each building element, which provides a building system that is very intuitive to use as the building elements of said system may only be coupled to each other in the correct and intended way.

According to an aspect, each edge of each single-piece element may be of equal length.

This has the advantage that symmetrical and precise polyhedral units may be assembled with such building elements. This further makes it easier to create three-dimensional structures, as all polyhedral units will be of equal side at every edge thereof, which lowers the risk of creating locking of said structures when manipulating them into various shapes and designs.

According to an aspect, each single-piece element may have four edges, wherein the single-piece element is square shaped.

This has the advantage that polyhedral units assembled of such building elements will be shaped as uniform and symmetrical cubes, which cubes are spatially easy to manage and design into a large variety of modifiable three-dimensional structures.

According to an aspect, a three-dimensional structure is provided. The structure may comprise at least two polyhedral units, wherein each polyhedral unit of said structure is hinged together with at least one adjacent polyhedral unit. Each hinged pair of polyhedral units being hinged together at edges of said polyhedral units. Wherein each polyhedral unit of the three-dimensional structure may be comprised of at least one single-piece element and at least one double-piece element according to disclosure.

This has the advantage that a three-dimensional structure is provided, which structure may be manipulated geometrically by means of shifting the relative positioning of polyhedral units with respect to each other, by means of tilting adjacent polyhedral units about their hinged edges. This may be utilized to create a variety of unique and visually interesting geometrical shapes that may be twisted and turned into one another to create visual performance art and similar. Such structures may be used as kinetic sculpture, playing games with, training motor skills with, geometrical puzzles and also be used as different types of practically usable geometric objects, such as foldable furniture or structural building components for example.

BRIEF DESCRIPTION OF THE DRAWINGS

Below is a description of, as examples, embodiments with reference to the enclosed drawings, in which.

DETAILED DESCRIPTION

The description of the various features, and modifications thereof, with reference to the embodiments depicted are to be viewed as exemplary embodiments comprising a combination of certain features, will herein be described in more detail. It is thus to be understood that additional embodiments may be achieved by combining other features into embodiments not depicted herein. The figures are to be viewed as examples and not mutually exclusive combinations. It should also be noted that all figures shown and described are schematically represented, wherein generic parts of elements, structures or similar may not be depicted for the sake of simplicity.

Figure 1A:
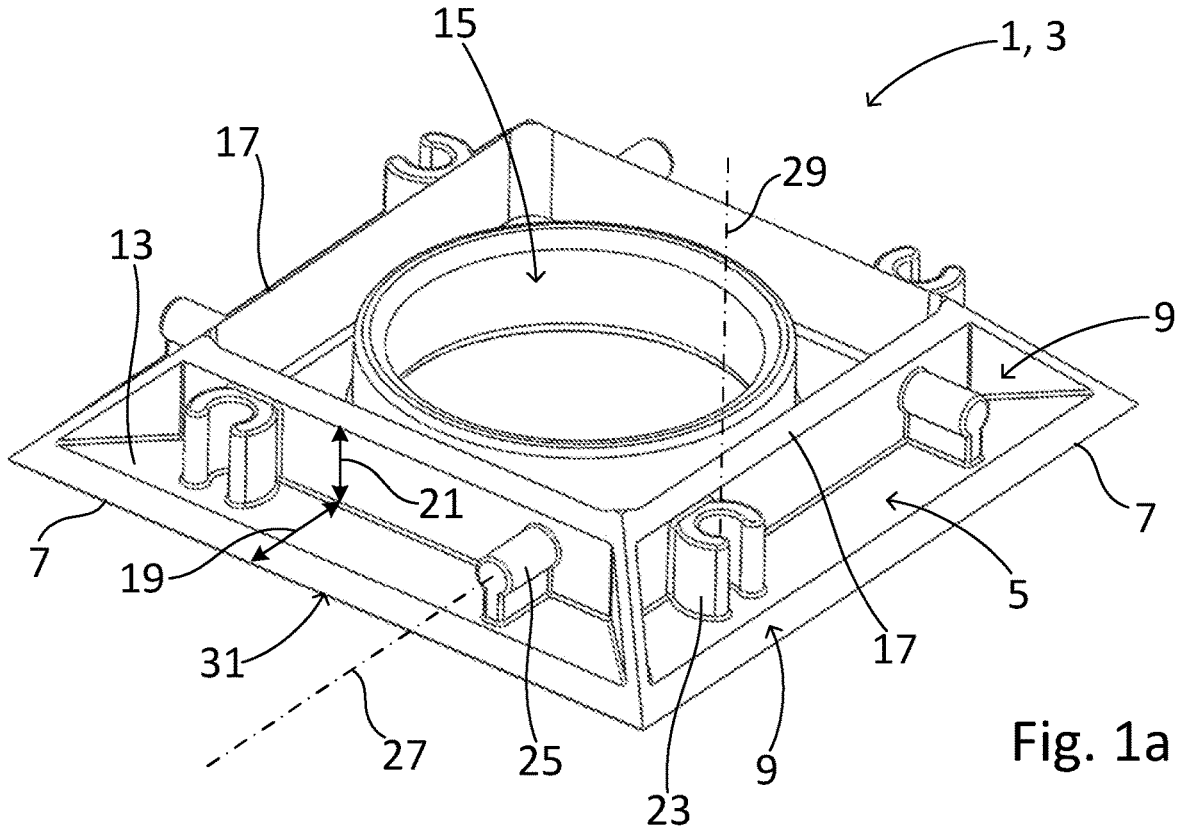
FIGS. 1*a-b* show a single-piece element of a building system, in perspective views, according to an embodiment.
Figure 1B:
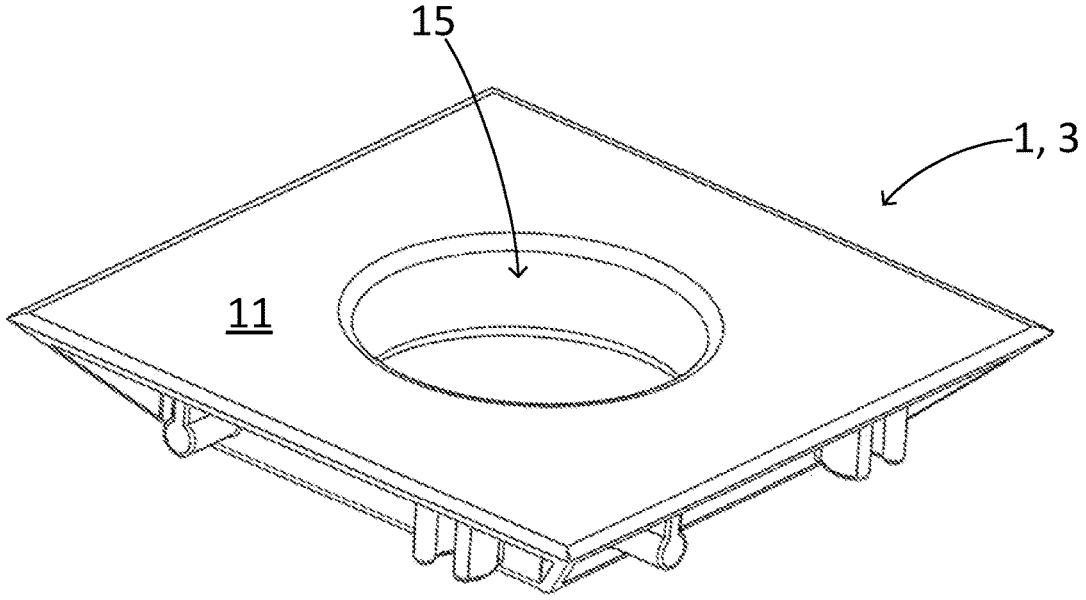

FIGS. 1*a-b* show a single-piece element 1 of a building system, in perspective views, according to an embodiment. The building system may be used for creating three-dimensional structures, which structures may be comprised of a plurality of polyhedral units, wherein each said unit may be hingedly coupled to at least one adjacent unit. The plurality of hinged polyhedral units may then be arranged to be interchangeably manipulated between various forms of said three-dimensional structures. Such structures may have various usages ranging from visual art to useful objects that are transformable between different shapes. The building system according to the disclosure may comprise at least two types of plate-like building elements 3, a single-piece element 1 and a double-piece element, wherein an embodiment of a single-piece element 1 is depicted in FIGS. 1*a-b*. An inner portion 5 of each edge 7 of each element 1, 3 may be provided with coupling means 9 arranged for coupling elements 1, 3 together along their edges 7 so as to create the previously mentioned polyhedral units. The building system according to the disclosure may be used to create three-dimensional structures, wherein said structures are constituted by a plurality of said polyhedral units, wherein each such unit is comprised of at least one single-piece element 1 and at least one double-piece element.

The single-piece element 1 shown in FIGS. 1*a-b* is illustrated in perspective views but from different angles. Each building element 3 of the building system may comprise an outer surface 11 and an inner surface 13, wherein the coupling means 9 of each edge 7 of each building element 3 are arranged at the inner surfaces 13 of the building elements 3. FIG. 1*a* depicts the single-piece element 1 exhibiting its inner surface 13 provided with coupling means 9, and FIG. 1*b* depicts the single-piece element 1 exhibiting its outer surface 11. FIGS. 1*a-b* are thus to be viewed as illustrations of the same embodiment of such a single-piece element 1, seen from different sides. Each single-piece element 1 may further comprise a through-hole 15 at a centre of each said element 1, which is seen in both of FIGS. 1*a-b*. The through-hole 15 will be described in more detail later on in the disclosure with reference to FIGS. 3*a-b*.

It should herein also be noted that the term single-piece element 1 may refer to a sole single-piece element 1 as a building element 3 of the building system, but also as a part of a double-piece element, wherein the double-piece element is to be perceived as one building element 3 of the system. When a double-piece element is mentioned, it is thus to be viewed as two single-piece elements 1 connected to each other, and when a general wording of building elements 3 is mentioned it is to be viewed as a plurality of single-piece elements 1 and/or double-piece elements. Thus, when it is mentioned above that, "each single-piece element 1 may further comprise a through-hole 15 at a centre of each said element 1", it should be viewed as describing each single-piece element 1, either on their own or as part of a double-piece element.

Turning the attention to FIG. 1*a* and the details depicted therein, the coupling means 9 and their arrangement to the single-piece element 1 may be studied in more detail. The coupling means 9 of each edge 7 of each building element 3 may be arranged at the inner surfaces 13 by means of intermediate flanges 17. Said flanges 17 may protrude perpendicular to the inner surface 13 and extend parallel to each edge 7, at a distance 19 from said each edge 7, which distance 19 is equal in length to a protruding length 21 of the flanges 17. The flanges 17 provide a more stable and rigid arrangement for the coupling means 9, and provide protection from impacts with objects that approach the coupling means 9 from the through-hole 15 of the building element 3. The flanges 17 also make the building elements 3 stronger and more rigid to work with for a user of the building system. The equal length of the distance 19 and the protruding length 21 of the flanges 17 may be utilized in the best possible manner when such a single-piece element 1 is connected to an adjacent building element 3 oriented perpendicular to the single-piece element 1. If two such building elements 3 are arranged in such a fashion, the edges 7 of said building elements 3 and the flanges 17 of the same will align with each other, which will position the coupling means 9 in a protected and enclosed space. It should be noted however, that the inventive concept of the building system may be utilized for other angles of coupling of two building element 3, without deviating from the scope of protection as presented throughout the disclosure. If a non-perpendicular connection of two adjacent building elements 3 is desired, the protruding length 21 of the flanges 17 and/or their positioning relative the edges 7 of the single-piece elements 1 may be modified to provide the same effect as described herein, but for other types of assembled polyhedral units.

The embodiment according to FIGS. 1*a-b* is shown to have a design in which each edge 7 of the single-piece element 1 is of equal length. Furthermore, the embodiment of the single-piece element 1 depicted herein has four edges 7, wherein the single-piece element 1 is square-shaped. Such as design of the single-piece elements 1 may thus be used to assemble cube shaped polyhedral units. When assembled as such, six single-piece elements 1, either on their own or as parts of double-piece elements will constitute a symmetrical cube having six surfaces, which surfaces correspond to the outer surfaces 11 of the building elements 3, as depicted in FIG. 1*b*. Such an assembly will be described in more detail with reference to FIG. 4. As should be understood, a single-piece element 1 may also be comprised of another number of edges 7, but still utilize the same building concept. A single piece element 1 may for example have three edges, when if of equal length may be assembled as a polyhedral unit having a pyramid shape instead.

The coupling means 9 of each edge 7 of each building element 3 may be comprised of a claw 23 and a pin 25, wherein coupling of two building elements 3 is achieved by means of a pin 25 of one building element 3 being fitted into a claw 23 of an adjacent element, and vice versa. As is seen in FIGS. 1*a-b*, the pins 25 of the coupling means 9 may be oriented so that a centre line 27 of said pins 25 extends outwards from the single-piece element 1, and having an extending direction and orientation parallel with the outer surface 11 of the single-piece element 1. Correspondingly, the claws 23 of the coupling means 9 may be shaped to conform to the shape of the pins 25 (in this case substantially having a circular circumference), wherein a centre line 29 of the internal volume partly encircled by the claw 23 extends in a direction perpendicular to the inner surface 13 of a single-piece element 1 to which it is arranged. If two building elements 3 are coupled together, edge 7 to edge 7 and with perpendicular orientations relative each other, said two centre lines 27, 29 will thus align, wherein the claws 23 and pins 25 of said two building elements 3 may be coupled to each other so as to provide a reliable coupling of the two adjacent building elements 3. By means of utilizing the two centre lines 27, 29 of the claw 23 and the pin 25, which centre lines 27, 29 are perpendicular to each other in orientation, a coupling of opposite claws 23 and pins 25 may never slide out of each other in one single direction. The two independent parts of such an embodiment of the coupling means 9 will thus complement each other to achieve a coupling that holds reliably in a plurality of directions.

Furthermore, each edge 7 of each building element 3 may further comprise one claw 23 and one pin 25 (as depicted in FIGS. 1*a-b*), wherein for each edge 7, the claw 23 and the pin 25 are positioned at opposite sides of a centre 31 of said edge 7, at an equal distance from said centre 31. Such an arrangement of the claws 23 and pins 25 ensure a smooth alignment of two adjacent building elements 3 when coupled to each other, as the centres 31 of said two adjacent building elements 3 will align with each other. Such a coupling will also always align the edges 7 of such building elements to each other, which in turn provides the correct positioning of said building elements 3 for constituting a first assembly step of a correct polyhedral unit according to the building system. Furthermore, as such an arrangement forces a user of the building system to couple building elements 3 to each other in a single possible way, the building system becomes more intuitive to said user. It should herein be noted that the building elements 3 may comprise any number of claws 23 and pins 25 for each edge 7 of each building element 3, as long as a symmetrical arrangement of said claws 23 and pins 25 is achieved. For larger types of structures, it may be more beneficial to provide a larger plurality of such combined claws 23 and pins 25 at each edge 7 of each building element 3, so as to provide a more reliable and durable connection between such larger building elements 3. Each such coupled pair of a claw 23 and a pin 25 must be arranged at equal distances from said centre 31 of each edge 7, so as to align the edges 7 of each building element 3 in a proper way.

Figure 2A:
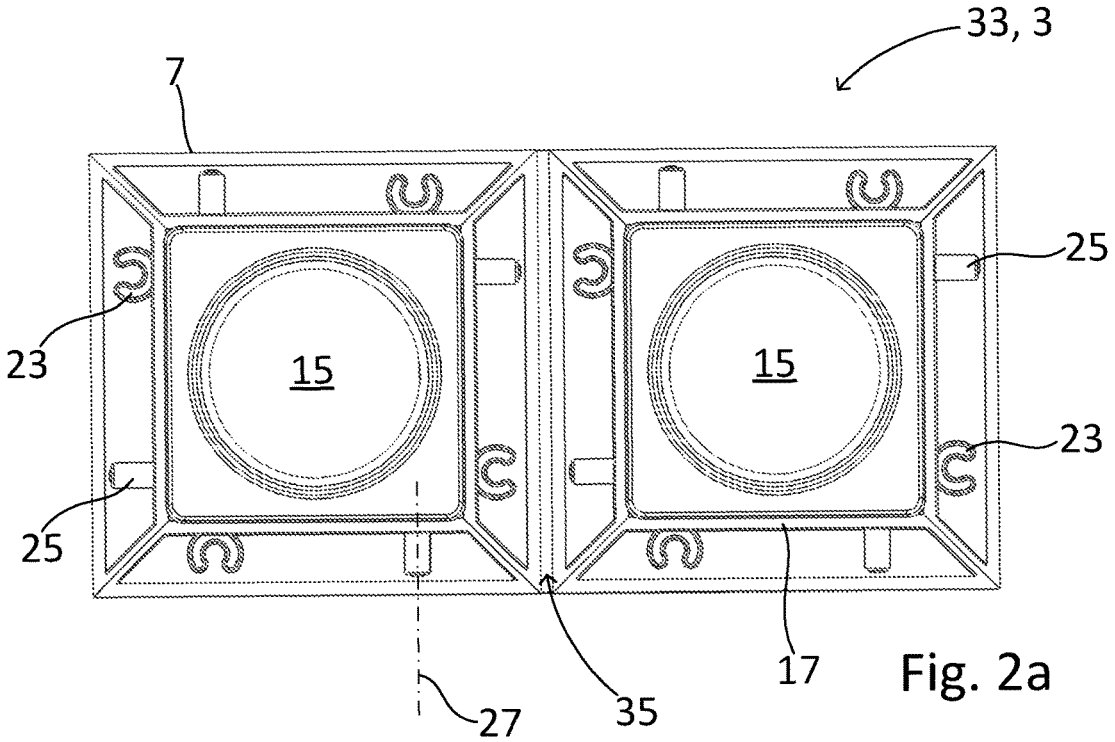
FIGS. 2*a-c* show a double-piece element of a building system, in different views, according to an embodiment.
Figure 2B:
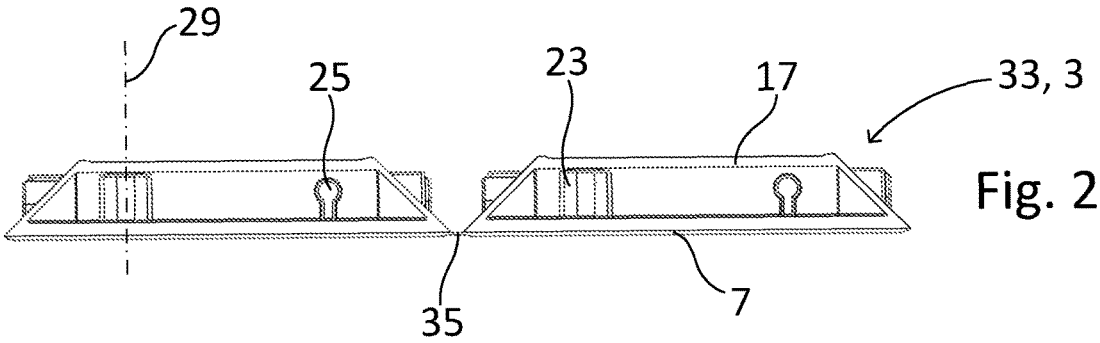
Figure 2C:
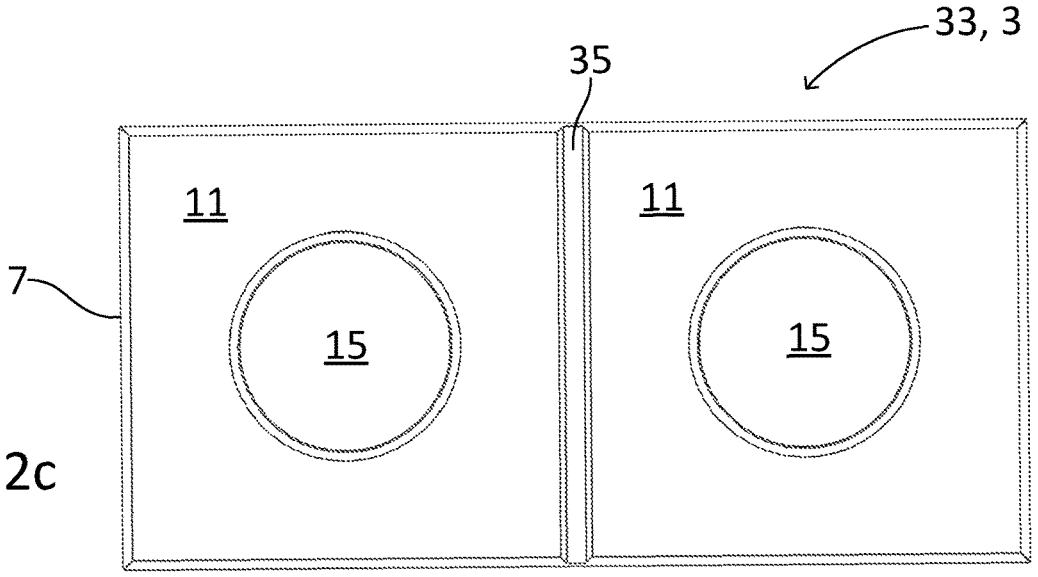

FIG. 2*a-c* show a double-piece element 33 of a building system, in different views, according to an embodiment. More precise, FIG. 2*a* depicts the double-piece element 33 in a top down view over the inner surfaces 13 of said element 33, FIG. 2*b* depicts the double-piece element 33 in a side view, and FIG. 2*c* depicts the double-piece element 33 in a bottom up view over the outer surfaces 11 of said element 33. This embodiment may be perceived as a double-piece element 33 of a building system comprising said double-piece element, and the single-piece element 1 shown in FIGS. 1*a-b*. Thus, the double-piece element 33 as shown in FIGS. 2*a-c* is to be perceived as being comprised of two single-piece elements 1 (as shown in FIGS. 1*a-b*) arranged adjacent each other and being hingedly attached to each other at one of the edges 7 of each of the two adjacently arranged single-piece elements 1. FIGS. 2*a* and 2*b* more clearly show the orientation of the centre lines 27, 29 of the pins 25 and claws 23 of the coupling means 9 respectively, and how they may be aligned if coupled together if imagining that the two views were to be joined together.

The building elements 3 may be made of a uniform material, wherein the hinged attachment of two single-piece elements 1 forming a double-piece element 33 may be comprised of at least one bridging strip 35 of said uniform material. The embodiment as depicted in FIGS. 2*a-c* comprises one such strip 35, as seen in the region between the two individual single-piece elements 1 forming the double-piece element 33 shown. FIG. 2*b* shows that said strip 35 of material is rather thin, which provides flexibility and thus the hinged functionality between the two single-piece elements 1. For the strips 35 to be flexible, the material from which the building elements 3 are made of, naturally needs to be a flexible material. Hence, the building elements 3 are preferably made of a polymeric material such as polypropylene (PP), however other polymeric materials may of course also be used if exhibiting suitable material properties. The building elements 3 themselves need to have a sufficient rigidity to be able to form stable polyhedral units and three-dimensional structures when assembled as such. The difference in thickness when comparing the thickness of the strips 35 and the remaining bulk material of the building elements 3 is thus what provides the different characteristics of the rigid building elements 3 and the flexible strips 35. Such characteristics may be provided to the building elements by means of using, for example, polypropylene as manufacturing material. The building elements 3 may then be manufactured by means of moulding, wherein said building elements 3 may be fast, easy and cost effective to manufacture, and provide the proper characteristics directly after manufacturing, demanding no further process steps to reach the final products. It is however also possible to manufacture the building elements 3 using a plurality of manufacturing material, so as to provide composite building elements 3. The hinged coupling of a double-piece element 33 may for example be made of an alternative material suitable for its desired mechanical properties. However, by manufacturing said building elements 3 as uniform pieces of only one ingoing material, manufacturing costs may be lowered and the process more time effective.

Figure 3A:
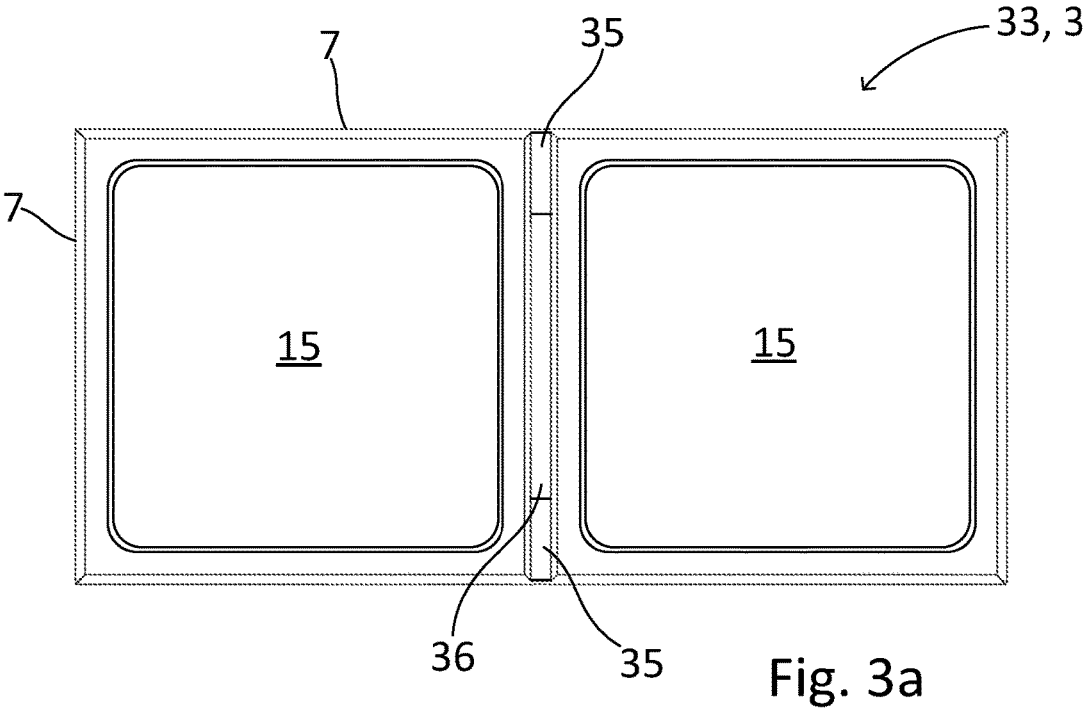
FIGS. 3*a-b* show double-piece elements of a building system, in top down views, according to alternative embodiments, FIG. 4 show a partly assembled polyhedral unit in a perspective view, according to an embodiment.
Figure 3B:
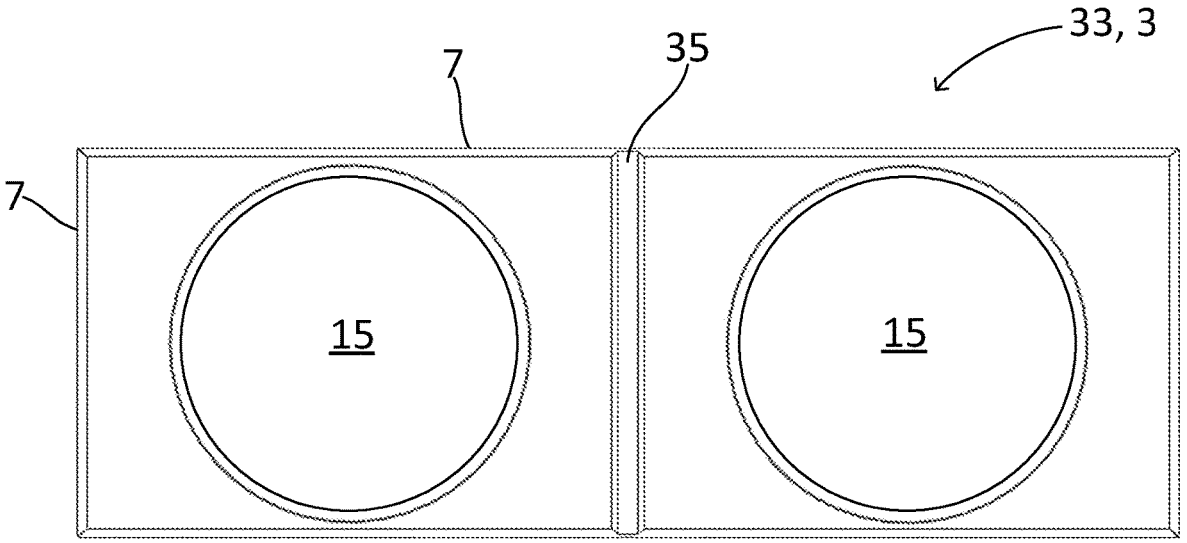

FIG. 3*a-b* show double-piece elements 33 of a building system, in top down views, according to alternative embodiments. Both FIG. 3*a* and FIG. 3*b* show different embodiments of a double-piece element 33 of a building system in a top down view looking at the outer surfaces 11 of said elements 33. FIG. 3*a* show one such embodiment of a double-piece element 33 that is provided with a through-hole 15 of a different shape and size compared to previously shown and explained embodiments of a double-piece element 33. As is seen in FIG. 3*a*, said through-hole 15 is herein much larger compared to the total size of the individual single-piece elements 1, and having a squared shape with rounded edges. When such an embodiment of building elements 3 are used to assemble polyhedral units and three-dimensional structures, the visibility through said through-holes 15 is increased, and such assembled arrangements may thus have a visually lighter appearance, and may also provide easier handling of the structure as there are thinner structural elements to grab for a user of the building system.

Furthermore, which may also be viewed in FIG. 3*a*, the hinged attachment of the two individual single-piece elements 1 constituting the double-piece element 33 shown is provided with two bridging strips 35, with a gap 36 there between, between said two single-piece elements 1. As the total length of said two strips 35 is obviously smaller compared to a single strip 35 running along the entirety of the edges 7 as shown with reference to FIGS. 2*a-c*, the flexibility of said strips 35 will naturally be changed as well. Thus, the two strips 35 as shown in FIG. 3*a* may be made slightly thicker compared to a single strip 35, and combined still provide the same flexibility for the hinged connection. As should be understood, the total number of strips 35 used may vary between a single strip 35 and a large plurality of smaller strips 35, wherein the total number of strips 35 and their thickness may be utilized as a means of modifying the flexibility and durability of the hinged coupling they provide.

FIG. 3*b* depicts another alternative embodiment of a double-piece element 33 that has a non-uniform length of the edges 7 of the individual single-piece elements 1. As should be understood, polyhedral units assembled with such building elements 3 will not have a symmetrical cube-shape but rather a cuboid shaped geometry.

As should be obvious, the embodiments described with reference to FIGS. 3*a-b* are not the only possible alternative embodiments to fall within the scope of protection defined by the disclosure herein. FIGS. 3*a-b* are merely illustrations showing a couple of modifications that may be made to certain features. The total number of edges 7 constituting the circumference of the building elements may be changed so as to provide building elements having fewer or more edges 7. The through-holes 15 may be altered in size or shape or even be removed altogether. The orientation of the centre lines 27, 29 of the connection means 9 may be angled so as to fit other angles than 90°, or other.

Figure 4:
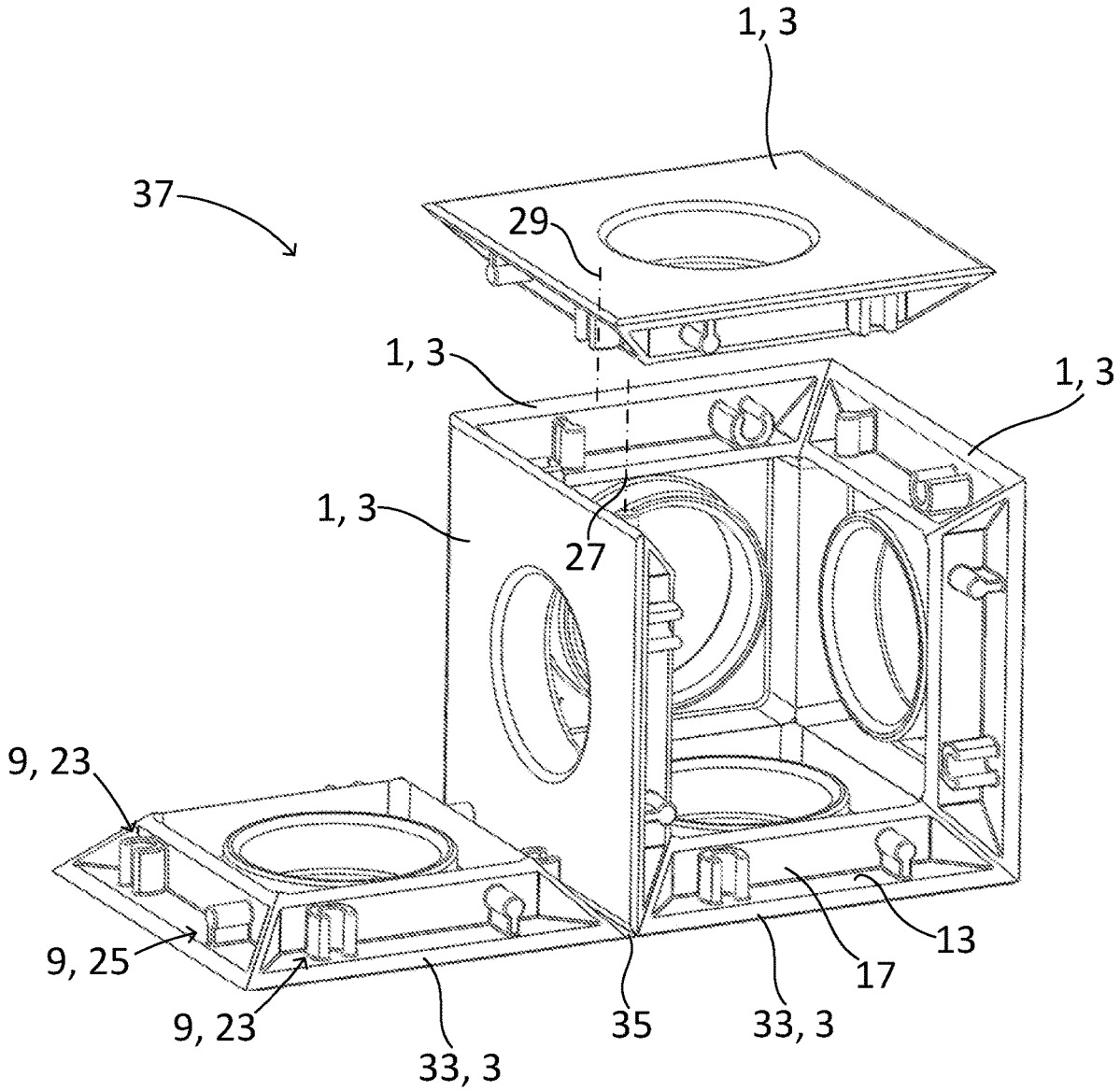
Figure 5D:
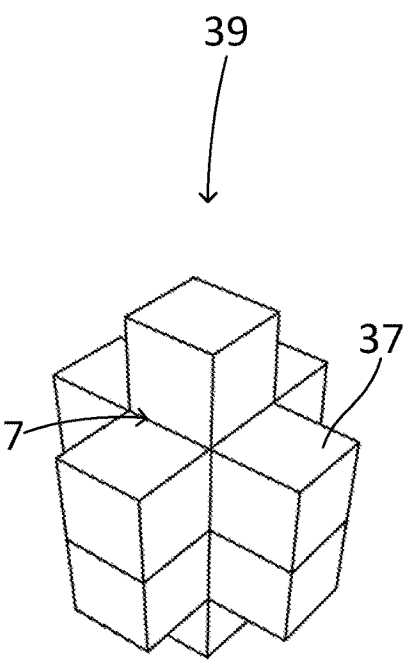
FIGS. 5*a-d* show a three-dimensional structure in different stages of geometrical modification.
Figure 5C:
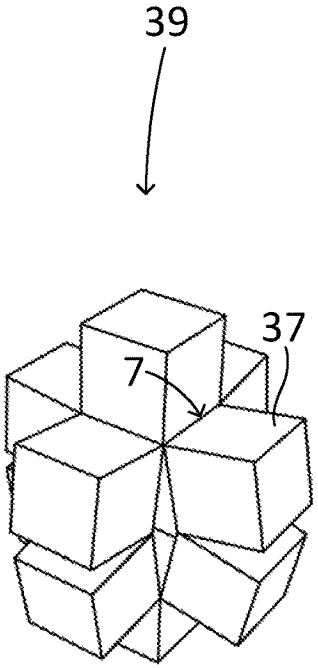
Figure 5B:
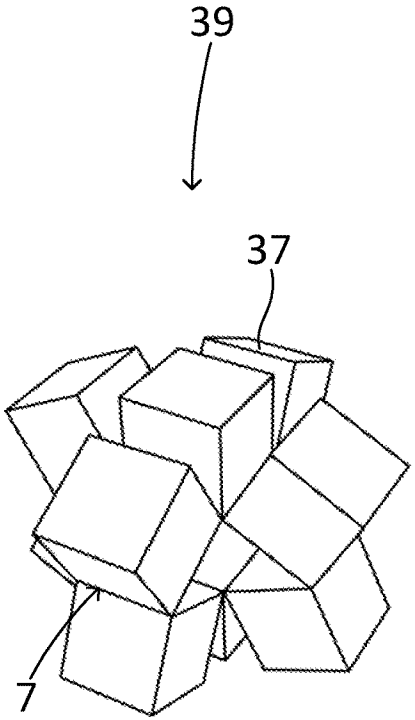
Figure 5A:
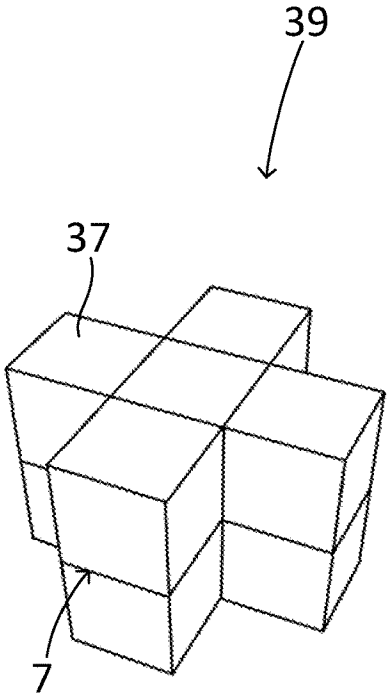

FIG. 4 show a partly assembled polyhedral unit 37 in a perspective view, according to an embodiment. The partly assembled polyhedral unit 37 may be perceived as being achieved by connecting a plurality of single-piece elements 1, as described with reference to FIGS. 1*a-b*, and one double-piece element 33, as described with reference to FIGS. 2*a-c*. The total number of single-piece elements 1 shown in the illustration is four, wherein three are connected to the double-piece element 33 being situated at the bottom of the assembly as shown, and the fourth being shown above the partly completed unit 37. As is seen herein, the double-piece element 33 is thus coupled to the polyhedral unit 37 by means of one of its single-piece elements 1 of which it is comprised. The non-connected single-piece element 1 of the double-piece element 33 is thus freely movable by means of its hinged connection to the other single-piece element 1 of the double-piece element 33. Furthermore, as is clearly shown in FIG. 4, the coupling means 9 of the free single-piece element 1 of the double-piece element 33 are all free to be coupled to other building elements 3 of other additional polyhedral units 37, which units 37 combined create a three-dimensional structure when fully assembled. Even further, the open space at the front of the partly assembled polyhedral unit 37 is herein depicted as readily available to connect to another additional building element 3. If a single-piece element 1 is coupled thereto, the polyhedral unit 37 will be fully assembled and the sole double-piece element 33 being a part of the unit 37 provides the possibility of said unit being hingedly coupled to one adjacent separate unit 37. However, if a double-piece element 33 is coupled to the open space at the front of the polyhedral unit 37, said polyhedral unit 37 may thus be provided with another second hinged coupling to one more adjacent polyhedral unit 37. As should be understood, such an additional double-piece element 33 being coupled to the open space at the front of the polyhedral unit 37 may be oriented in any of the four possible directions available. That is, the single-piece element 1 of the additional double-piece element 33 not being coupled to the depicted unit 37 may extend from any of the edges 7 of the building elements 3, which edges 7 constitutes the circumference of said open space. Thus, the building system may be used to create an endless variation of this type of polyhedral units 37, wherein any edge 7 of the polyhedral unit 37 may be provided with a hinged coupling to an adjacent additional unit 37. Depending on where the hinged couplings are arranged throughout a three-dimensional structure, said structure may be modified in shape in different ways, to provide visual interest, a kinetic sculpture, a motoric training tool/toy, or a practically useful geometrical object. One example of such a three-dimensional structure will be described with reference to FIGS. 5*a-x*.

The claws 23 and pins 25 of the coupling means 9 of the building elements 3 as depicted in FIG. 4 may therein be seen in more detail when being part of the assembly as shown. Herein it is shown how the centre lines 29, 27 of the claws 23 and pins 25 respectively align in orientation with all corresponding such centre lines 27, 29 of adjacent building elements 3, and that they complement each other by means of being arranged in an alternating pattern of orientations. The single-piece element 1 as shown above the partly assembled polyhedral unit 37 may be pushed downwards with an amount of force that pushes the horizontally oriented pins 25 into the claws 23 below, wherein the claws 23 of the upper single-piece element 1 will simply slide down on their respective opposite positioned pins 25. This ensures that no building element 3 may be removed from a polyhedral unit 37 by means of only a sliding motion in one direction, which provides reliable couplings between the building elements 3. It may also be seen how the flanges 17 arranged at the inner surfaces 13 of the building elements 3 align with each other so as to completely seal the coupling means 9 within closed off spaces, which alleviates the risk of damaging said coupling means 9, and achieves a sleeker and more visually pleasing polyhedral unit 37.

It should also be mentioned that the concept of the building system of course may be expanded even further, wherein triple-piece element, or similarly constructed building elements 3 made up of up to having all edges 7 of a single-piece element 1 being connected to another adjacent single-piece element 1. By means of the intuitive yet robust coupling means 9 of the building elements 3 of the building system, any single or a plurality of building elements 3 may at any later point in time be removed and be replaced with another type of building element to create a new type of three-dimensional structure, which may have new characteristics and/or functionality.

It should even further be mentioned that single polyhedral units 37 may of course also be assembled by means of the building system according to the disclosure. Such single polyhedral units 37 may thus not be coupled to any adjacent unit. Such a single polyhedral unit may be assembled either by means of connecting only single-piece elements 1 together, or by a combination of single-piece elements 1 and double-piece elements 33, but for which double-piece elements 33 the hinged connection is positioned at a corner within such a unit. If the double-piece element 33 in the partly assembled polyhedral unit 37 as shown in FIG. 4 is rotated so that the free single-piece element 1 of the double-piece element is positioned at the open space of the unit instead, said free single-piece element 1 may simply be tilted upwards to complete the unit.

FIG. 5*a-d* show a three-dimensional structure 39 in different stages of geometrical modification. The disclosure as presented herein is to be viewed as relating to any three-dimensional structure 39 assembled by means of the building system according to said disclosure. Generally, such a three-dimensional structure 39 may thus comprise at least two polyhedral units 37, wherein each polyhedral unit 37 of said structure 39 is hinged together with at least one adjacent polyhedral unit 37. Each hinged pair of polyhedral units 37 are further hinged together at edges 7 of said polyhedral units 37. The example shown in FIGS. 5*a-d* is comprised of ten polyhedral units 37, having the shape of cubes, chosen for the sake of simplicity. Each such polyhedral unit 37 of the three-dimensional structure 39 is comprised of at least one single-piece element 1 and at least one double-piece element 33 according to the disclosure herein. The structure 39 as presented in FIG. 5*a* may be perceived as a starting form of said structure 39, wherein the polyhedral units 37 being hingedly coupled to adjacent units 37 are tilted away or towards each other bit by bit for each FIG. 5*a-d* until a second form is reached in FIG. 5*d*. All such movement is thus achieved by a plurality of such hinged coupling between adjacent polyhedral units 37, which units 37 may be moved simultaneously if the hinged couplings are arranged in a correct manner to avoid locking of units 37 relative each other. This provided example of a possible three-dimensional structure 39 is thus by far not the only possible structure to create, but only a single example to exhibit the functionality of such a three-dimensional structure 39 having a plurality of hinged couplings therein.

Figures 6A, 6B, 6C, 6D, 6E:
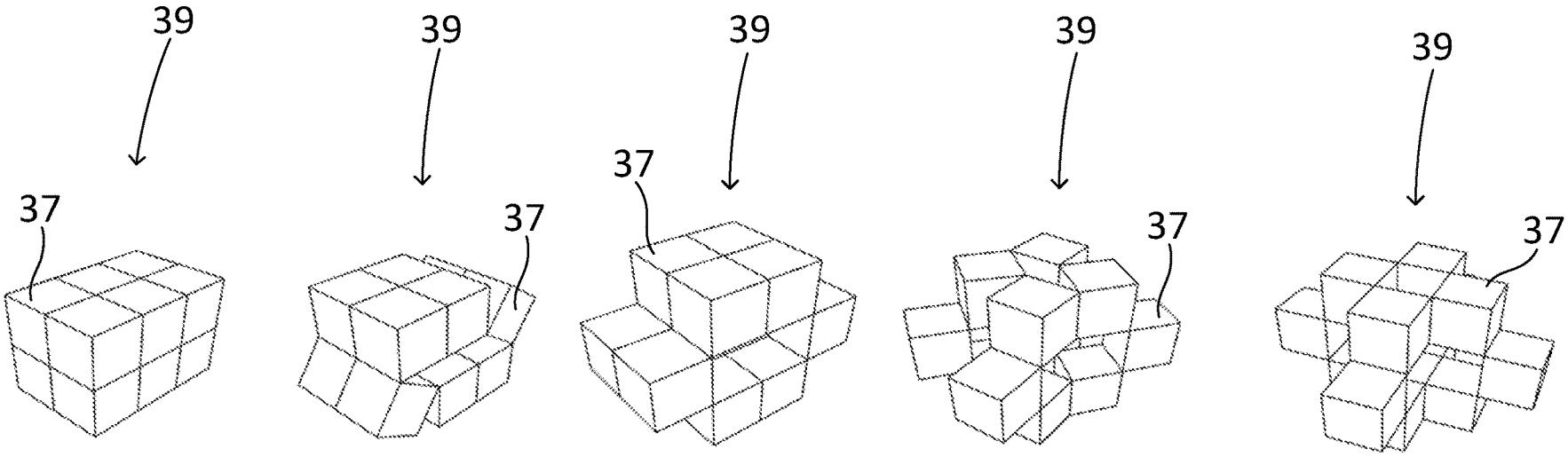
FIGS. 6*a-e* show an alternative three-dimensional structure in different stages of geometrical modification.

FIGS. 6*a-e* show an alternative three-dimensional structure 39 in different stages of geometrical modification. This alternative three-dimensional structure 39 will not be explained in detail, wherein it should be understood that the functionality and ability to be moved between its various forms, as shown in FIGS. 6*a* and 6*e*, mirrors the three-dimensional structure 39 shown in FIG. 5*a-d*, only differing in the distinct shapes and forms the two examples exhibit in their respective illustrations.

Depending on the desired usage, the structures 39 may of course be planned, assembled, and used in different ways. As has been mentioned, these types of three-dimensional structures 39 may be used in large variety of ways, such as visual performance art, kinetic puzzles, toys, or even foldable pieces of furniture or structural building components.

The foregoing description of the embodiments has been furnished for illustrative and descriptive purposes. It is not intended to be exhaustive, or to limit the embodiments to the variations described. Many modifications and variations will obviously be apparent to one skilled in the art. The embodiments have been chosen and described in order to best explicate principles and practical applications, and to thereby enable one skilled in the arts to understand the invention in terms of its various embodiments and with the various modifications that are applicable to its intended use. The components and features specified above may, within the framework of the disclosure, be combined between different embodiments specified.

The invention claimed is:

1. A building system for creating three-dimensional structures, which three-dimensional structures are comprised of a plurality of polyhedral units, each polyhedral unit being hingedly coupled to at least one adjacent polyhedral unit, wherein the plurality of hingedly coupled polyhedral units is arranged to be interchangeably manipulated between different forms of said three-dimensional structures, the building system comprising:

at least two types of building elements, including:

a single-piece element having at least three outer edges which constitute a circumference of said single-piece element; and a double-piece element comprised of two single-piece elements arranged adjacent each other and being hingedly attached to each other by at least one bridging strip extending directly from one of the two single-piece elements to the other of the two single-piece elements, wherein an inner portion of each outer edge of each building element is provided with coupling means arranged for coupling the building elements together along the outer edges thereof so as to form a plurality of polyhedral units forming a three-dimensional structure, each polyhedral unit being comprised of at least one single-piece element and at least one double-piece element, wherein each building element comprises an outer surface, an inner surface, and a plurality of flanges protruding away from the inner surface, each flange of the plurality of flanges being spaced inward from a corresponding one of the outer edges, wherein each coupling means of each building element is formed integrally with the inner surface along at least one flange of the plurality of flanges.

2. The building system according to claim 1, wherein the at least two types of building elements are made of a uniform material.

3. The building system according to claim 1, wherein the at least one bridging strip is flexible.

4. The building system according to claim 1, wherein each flange of the plurality of flanges protrudes perpendicularly away from the inner surface.

5. The building system according to claim 4, wherein each flange of the plurality of flanges extends parallel to the corresponding one of the outer edges.

6. The building system according to claim 1, wherein the coupling means of each outer edge of each building element is comprised of at least one claw and at least one pin, wherein coupling of two building elements is achieved by the at least one pin of one building element being fitted into the at least one claw of an adjacent building element.

7. The building system according to claim 6, wherein for each outer edge of each building element, the at least one claw and the at least one pin are positioned at opposite sides of a center of the outer edge at an equal distance from said center.

8. The building system according to claim 1, wherein each outer edge of each single-piece element is of equal length.

9. The building system according to claim 8, wherein each single-piece element has four outer edges, wherein the single-piece element is square shaped.

10. The building system according to claim 1, wherein each flange of the plurality of flanges is arranged inward from said corresponding outer edge by a distance equal to a protruding length of the flange.

11. The building system according to claim 1, wherein for each double-piece element, the at least one bridging strip is a living hinge formed integrally with the two single-piece elements and extending from one of the outer edges of one of the two single-piece elements to one of the outer edges of the other of the two single-piece elements.

12. The building system according to claim 1, wherein for each double-piece element, the at least one bridging strip comprises two bridging strips.

13. A building system for creating three-dimensional structures, comprising:

at least two types of building elements comprising a single-piece building element and a double-piece building element, wherein the double-piece building element comprises two single-piece building elements hingedly attached by at least one bridging strip, each of the at least two types of building elements comprising:

an outer surface and an opposite inner surface;

at least three outer edges defining a circumference of said inner surface;

a plurality of flanges, wherein each flange has a fixed position protruding perpendicularly away from the inner surface and is spaced inward from one of the at least three outer edges; and coupling means formed where the inner surface meets each flange of the plurality of flanges.

14. The building system of claim 13, wherein the coupling means are formed integrally with at least one of the inner surface or the flange.

15. The building system of claim 13, wherein each bridging strip extends directly from one of the two single-piece elements to the other of the two single-piece elements.

16. The building system of claim 13, wherein each bridging strip is a living hinge formed integrally with the two single-piece elements and extending from one of the outer edges of one of the two single-piece elements to one of the outer edges of the other of the two single-piece elements.

17. The building system of claim 13, wherein the coupling means comprise at least one claw and at least one pin.

18. The building system of claim 13, wherein each flange is spaced inward from one of the at least three outer edges by a distance equal to a protruding length of the flange.

19. The building system of claim 13, wherein each flange of the plurality of flanges extends parallel to one of the at least three outer edges.

20. The building system of claim 13, wherein the plurality of flanges comprises one flange spaced inward from each of the at least three outer edges.

* * * * *